US006405907B1

(12) United States Patent
Roberts

(10) Patent No.: US 6,405,907 B1
(45) Date of Patent: Jun. 18, 2002

(54) FULLY INTEGRATED DRUM PUMP

(76) Inventor: Hess M. Roberts, 12 Crabapple Ct., St. Louis, MO (US) 63132

( * ) Notice: Subject to any disclaimer, the term of this patent is extended or adjusted under 35 U.S.C. 154(b) by 0 days.

(21) Appl. No.: 09/897,526

(22) Filed: Jun. 29, 2001

Related U.S. Application Data

(60) Provisional application No. 60/215,320, filed on Jun. 30, 2000.

(51) Int. Cl.[7] ..... B65D 88/54

(52) U.S. Cl. ..... 222/385; 222/530

(58) Field of Search ..... 222/43, 309, 319, 222/321.9, 385, 494, 527, 530

(56) References Cited

U.S. PATENT DOCUMENTS 4,174,055 A * 11/1979 Capra et al. ..... 222/319
4,684,032 A * 8/1987 Tsay ..... 222/527
6,264,120 B1 * 7/2001 Wintering et al. ..... 222/321.9
6,296,154 B1 * 10/2001 Shanklin et al. ..... 222/321.9

* cited by examiner

*Primary Examiner*—Philippe Derakshani
*Assistant Examiner*—Thach H Bui
(74) *Attorney, Agent, or Firm*—Paul M Denk

(57) ABSTRACT

A pump for use in combination with a drum, of varying sizes, to provide an easily fabricated and facily assembled pump from various molded components, that may be temporarily or permanently installed to the drum. The pump includes a pump cylinder, that fastens at its upper end to a cap ring that secures with the drum through its bung opening. The lower end of the pump cylinder engages with a lower cap, the lower cap connecting with the inlet tube for drawing fluids into the pump, during its usage, and the lower cap incorporates a valve, being of one-way design, that allows for passage of fluid into the pump, but prevents its discharge through the inlet tube, during functioning. A pump handle removably engages within the cap ring, can be drawn upwardly to provide for the pump stroke, and has connected to its downward end a pump rod, that has secured to its lower end the piston for the pump. The piston has a fluidic seal with the interior of the pump cylinder, and also includes a one-way valve, that allows for fluids within the lower piston chamber to bypass the valve and enter into the upper disposed pump chamber, as the pump is being cycled, to provide for cooperation between the plunger, the various gaskets associated with it and the lower cap, to cooperate and provide for drawing of fluids into the pump, and its pressure pumping therefrom, through a discharge hose, to a remote location for usage.

12 Claims, 5 Drawing Sheets

FULLY INTEGRATED DRUM PUMP

CROSS REFERENCE TO RELATED APPLICATION

This Application is related to and claims priority upon the Provisional Application having Ser. No. 60/215320, filed on Jun. 30, 2000.

BACKGROUND OF THE INVENTION

This invention relates principally to a new style of fully integrated pump for use in combination with a drum, or barrel, and which secures to its opening or bung, either permanently installed, or temporarily secured therein, but ready for immediate usage integrating all of its various components to render it fully operative.

A large variety of pumps have been available on the market, for use in combination for a variety of purposes, even for discharging the fluids from drums or barrels. Generally, large drums of the type referred to this application may come in multiple capacities weather it be a 15 gallon, 20 gallon, 30 gallon, or the standard 55 gallon type of drum, whether it be fabricated or steel, fiber, or plastic.

It is likely that various types of mechanical or steel pumps may have been inserted into drums, of the foregoing type, for pumping purposes and for discharging the drums content, but these type of pumps, if adapted for their usage, normally need to be cleaned after usage, are not of a permanent type of installation, and may have not been designed for usage specifically with a drum, and therefore, such pumps may not be most efficient in discharging the liquid contents from a drum.

On the other hand, it is known that the market potential for a pump of the type as designed and explained herein, may be voluminous, since it is known that approximately one hundred million barrels for various uses are sold annually in the United States. In addition, the market is significant and the need is just as great elsewhere throughout the Americas and in the overseas market. Thus, the need for a low cost portable pump that may be installed into the drum, perhaps even initially after the drum is filled and shipped with it, and in certain instances, even remain permanently installed therein, so that when the drum is shipped, stored, marketed, prepared for usage, an efficient pump is readily provided, allowing the purchaser immediately to discharge its contents from the drum, upon receipt. Such pump, of this design may be disposable, portable, or even of a permanent design.

There are a variety of uses that are made of drums of this type, and if they incorporate a pump therein, of the type as explained in this application, the usage and application of such a pump has ready market in the fields of sanitation chemicals, food extracts for food processors, the pharmaceutical industries, the petrochemicals business, and fluids used in the automotive fields, just to name a few of the more prominent type of industries in which usage of this invention may be made.

SUMMARY OF THE INVENTION

This invention contemplates the formation of a low cost polymer molded fully integrated drum pump, of the type that may be applied either permanently or temporarily to a drum, ready for usage and application for pumping out its liquid contents, More specifically, the drum pump of this invention is a fully integrated structure, having all of its various components for usage and for functioning as such a pump, in combination with a drum, integrated into its structure, and once applied to the drum, is readily available for usage for pumping and conveying liquid contents to a remote source for usage. The pump includes a formed pump cylinder having a chamber therein, within the chamber locates the plunger, the plunger having a piston located at its downward end, and which is capable of shifting vertically the full extent of the piston cylinder, so as to maximize the amount of liquid that can be pumped through each stroke or cycle of the piston, during its operation. The plunger, at its lower end, includes a piston, that provides the functionality for both pumping liquids from the drum, but at the same time, recharging the piston cylinder, in preparation for the next plunger discharge of liquid from the drum.

The pump cylinder includes a cap ring, which is molded as a substantially sturdy structure, and which can be readily engaged within the drum, to its bung opening, and which cap ring can be either temporarily installed, allowing for its ready removal, if necessary, or it can be permanently locked into position, when engaged within the drum, so as to prevent its unauthorized tampering and removal, and provides for its ready availability for usage, so long as the drum contains liquid content. In addition, the cap ring is structured such that it is effective in forming a fluidic seal between said cap ring, and the pump for that matter, with the drum, so as to prevent the leakage of any fluids at that location, even when the drum may be turned on its side, or upside down, during application or maneuvering Furthermore, the cap ring is formed such that it accommodates the storage of the pump hose therein, for its temporary retention interiorly of the plunger upper cap, until it is pushed out of the pump cylinder in preparation for usage of the pump for the conveying of the drum liquids.

In addition, the pump piston or plunger is fabricated such that it has a thin line profile, so that it may approach contiguity, or closeness, with the pump cylinder lower cap, in order to maximize the stroke of the plunger, while shifting its piston vertically within the pump cylinder, for obtaining a recharging of the said cylinder with liquid during usage of the drum applied pump.

Furthermore, during shipping and storage and before the pump is charged and set up for usage, notwithstanding its having been previously threadedly or otherwise engaged within the drum bung opening, the pump cylinder chamber will have ample capacity for holding and storing the pump hose within the chamber above the piston pump, and this is achieved by maintaining a close proximity between the pump upper cap, and the plunger piston, as both of these components are stationarily located, during assembly, before usage, at the lower region of the pump cylinder, and just above its lower cap such as during pump storage. Then, when the pump is readied for usage, and its plunger is elevated upwardly within the pump chamber, it draws the plunger upper cap upwardly, within the cylinder and into proximity just below the plunger cap ring, where it forms a fluid seal, and becomes permanently installed, and ready for usage. As this occurs, the pump hose likewise elevates out of the pump, from its coiled position during storage surrounding the pump rod and within the cylinder, thereby supplying a length of hose externally of the pump, and the drum, so that the discharging fluids, as they are being pumped from the drum, may be directed to any distant source, as desired.

These are the various features of this invention that are integrated into a rather portable and disposable, low cost, polymer molded pump, that may be readily used in application with any size drum, for pumping and discharge of its liquid contents.

The advantages from this type of invention, for a fully integrated style of pump formed of the various components as summarized above, can be reviewed as follows:

Initially, a pump of this structure is of a portable nature, fully integrated, and does not require assembly, or re-assembly, at the site of its usage, since it may be applied to the drum either initially, or at the place of usage, and immediately function to pump the liquid contents from its installed drum.

In addition, a pump of this design is highly efficient. As previously summarized, the pump upper cap has a full and efficient stroke within the pump chamber that brings it into very close contact with the lower cap of the pump, during its charging, and can be maneuvered into very close contact with a pump cap ring, or the pump upper cap at the upper end of the structure, thereby providing a maximum stroke for pumping a full capacity of liquid, from the drum, after it has been set up to pump, during its usage.

Furthermore, a pump of this design, as previously summarized, its fully effective for pumping liquids of various kinds, viscosities, and can be even be used with corrosive type of fluids, since the pump can be molded of various polymers that may be formulated to resist the corrosiveness of any liquid for which it is designed for usage. In addition, the structure of this pump is such that it is fully integrated, as previously explained, since its various parts have been carefully designed for immediate and permanent securement together, either by threaded engagement, snap fastening, which greatly facilitates the assembly of the pump at the site of its molding and manufactured, when produced. In addition, the type of valves within this pump, comprising at least two in number, which is of the flapper type, provides a very thin line dimension, so that the various valves can be brought into close proximity with each other, when used and installed within their various components, to again maximize, the amount of fluids that may be displaced, and pumped through this drum pump, during its application.

It is, therefore, the principle object of this invention to provide for a polymer molded pump which may have a variety of uses, easy to assemble, and interconnect its various components together, due to its specialized design, for application to a drum, to discharge its liquid contents.

Another object of this invention is to provide a universal and integrated type of pump that may be used for conveying a variety of chemicals, regardless whether they may be used in the sanitation field, the food manufacturing industry, applied by food processors, used to pump bulk pharmaceutical chemicals, applied in the petrochemical industry, and even used in the automotive industry, as may be desired. For example, its pump could be used in combination with a drum, that may hold an ample quantity of anti-freeze, either for use at an automotive maintenance facility, the service station, or even domestically in a garage. The user can simply manipulate the pump of this invention, and convey anti-freeze directly through the integrated hose of this pump, into the automotive radiator, to fill or supplement the charge of anti-freeze within the automobile as required. This is just an example.

Another object of this invention is to provide a drum pump which has a highly efficient stroke for conveying fluids and discharging the same from its storage container during usage.

Another object of this invention is to utilize valves within the pump of this design, which are the thin lined construction, to thereby maximize the amount of fluids that may be processed, conveyed, and discharged from a drum through usage of this pump.

Still another object of this invention is to provide for a fully integrated molded pump where all of its components, even including the coil hose, can be stored within the pump in preparation for usage, and readily set up when it is desired to employ the pump for discharging the drum liquid contents.

Still another object of this invention is to provide for the fabrication of the pump, which includes a uniquely styled cap ring, and which can be engaged, either by threaded engagement, by a bayonet lock, or any other means of fastening, within the drum for usage, and can even be permanently installed therein, to prevent its unauthorized removal, as may be desired.

These and other objects may become more apparent to those skilled in the art upon review of the summary of the invention as provided therein, and upon undertaking a study of the description of its preferred embodiment, in view of the drawings.

BRIEF DESCRIPTION OF THE DRAWINGS

In referring to the drawings, FIG. 1 provides a side view of a standard drum, disclosing the installation of the pump of this invention therein.

DESCRIPTION OF THE PREFERRED EMBODIMENT

Figure 1:
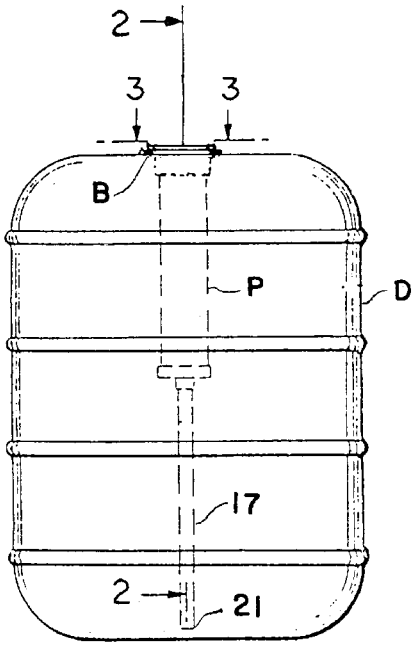

In referring to the drawings, and in particular FIG. 1, the pump P of this invention is disclosed, is secured in proximity to the bung opening B of the shown drum D. The pump P of this invention is generally disclosed in FIG. 2. It includes a pump cylinder 1 that secures within the cap ring 2, the cap ring, in turn, is fastened within the upper portion of the drum D in the vicinity of its bung opening B by threaded engagement, a bayonet lock, or any other means for fastening of these components securely together. In addition, to provide for a fluidic seal at this location, a seal, such as the O ring 3 may be provided beneath the flange 4 of the cap, as can be noted. Retained within the cap ring 2 is the plunger handle 5 and this also may be secured by means of any type of fastening, such as a bayonet lock, threadily engaged, or by any other means, that provides for a holding of the handle in place, but allows for its ready removal, to promptly achieve a pumping action through usage of this invention. Securing to the bottom of the handle 5 is the pump rod 6, that extends downwardly towards the lower end of the cylinder 1. The pump rod, at its lower end, secures to the piston 7 of the plunger, as can be noted. The piston 7 has at least one aperture or passage 8, provided therethrough, which allows for passage of the pump fluid to move there-through during usage of this pump.

A valve 9 is arranged across the top surface of the plunger 7 as can be noted. This functions somewhat as a flapper valve, so that as the plunger moves downwardly, within the pump cylinder 1, fluid will pass through the passages 8, force open the valve 9, and accumulate within the pump chamber 10 to charge the pump for discharge of the drum fluids.

Obviously, both the pump rod 6, its handle 5, and the plunger or piston 7, move upwardly and downwardly, during a cycle, to produce the stroke within the pump cylinder 1, as will be subsequently described.

Figure 5:
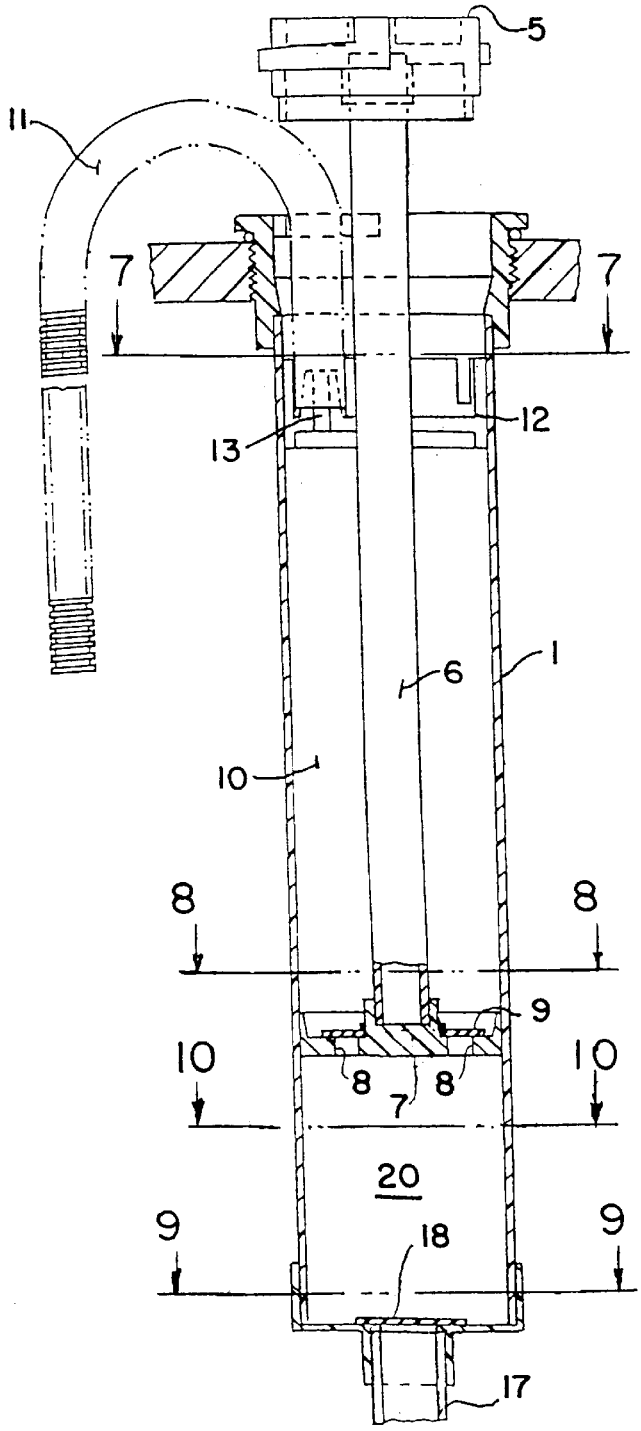
FIG. 5 is a side view, partially in section through the pump cylinder, disclosing all of the integrated components of the pump of this invention.

In addition, it can be seen that the pump hose 11 is coiled about the pump rod 6, within the cylinder 1, and this is the position for storage of the hose, after the pump has been manufactured, assembled, and even installed within the drum D, but before its initial usage. When the pump is ready for usage and application, its hose 11 will extend externally of the pump chamber 10, through the top of the cylinder 1, as can be seen in FIG. 5.

Figure 2:
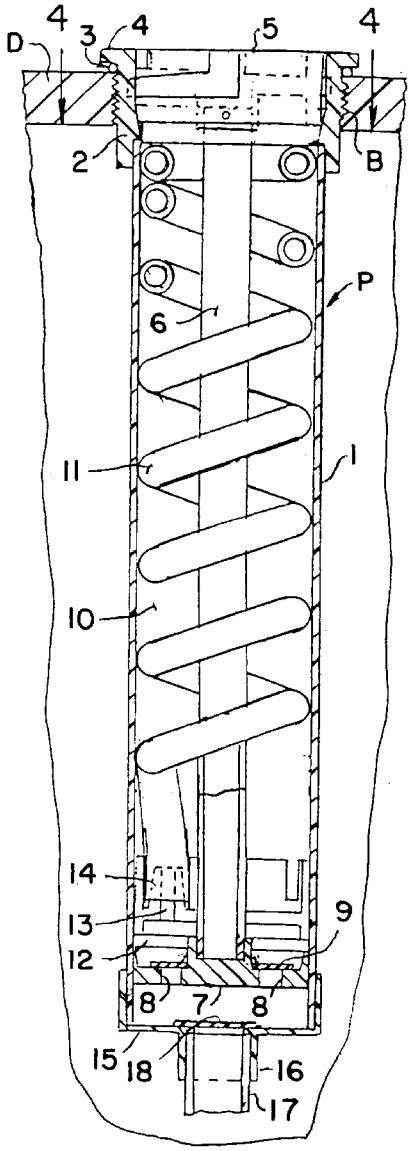
FIG. 2 provides a vertical sectional view taken through the pump, as shown as along line 2—2 of FIG. 1.

Within the pump chamber 1 is the upper cap 12. This upper cap, its detailed structured and configuration to be subsequently described, has a tubular passage 13 formed therewith and the hose 11, at its lower end 14, is secured thereon. Thus, when the pump is manufactured, but before usage, and is in the configuration as shown in FIG. 2, the upper cap 12 will actually be maintained in the lower segment of the pump cylinder 1, as can be noted in said FIG. 2. But, when the pump is readied for usage and the plunger 7 is pulled upwardly by means of the elevation of the handle and pump rod 6, it slides the cap 12 upwardly within the said cylinder, until it reaches a position just beneath the cap ring 2, and remains there permanently, as can be seen in FIG. 5. Thus, fluids are allowed to pass from the pump chamber 10, through the passage 13, and out of the hose 11, as the pump is being stroked, as during usage.

The bottom of the pump cylinder 1 includes a lower cap 15, which is permanently secured thereto, and the lower cap includes an integral segment of a tube 16, and into which the inlet tube 17 secures, within the said tube 17, extending downwardly into proximity with the bottom of the drum D, as can be noted in FIG. 1. The lower cap 15 includes a valve 18, which provides an inlet flapper valve, at the bottom of the pump, and through which the fluids are drawn, during usage and manipulation of a pump of this invention.

In operation, the pump's various components, as generally and broadly described herein, function within the pump to produce a discharge of the drum's contained fluids under some degree of pressure for conveyance through the hose 11, and to a remote location for usage. For example, when the pump is structured in the position as shown in FIG. 2, which is its initial storage condition, in preparation for usage, all the operator need do is to release the pump handle 5 from its bayonet or other fastening within the cap ring 2. This is done by simply returning the upward projections 19, integrately furnished upon the upper surface of the handle 5, and which can easily be manipulated by the fingers for turning the handle a few degrees, perhaps a quarter turn, to disengage the pump handle from its cap ring 2, and then, the handle 5 can be pulled upwardly, which likewise draws the plunger piston 7 upwardly, due to its engagement with the pump rod 6. As this occurs, the coil hose 11 begins to appear and becomes positioned upwardly of the cap ring 2, externally of the drum D, and when the plunger 7 is pulled entirely upwardly, within the pump cylinder 1, the entire coil hose will be free for lengthening and for conveyance of fluids. As this occurs, likewise the upper cap 12 of the plunger will be shifted upwardly, within the structure of the pump cylinder 1, until such time as it attains an uppermost position, in the manner as previously shown in FIG. 5. When the pump is set up as shown in FIG. 5, it is ready for usage for the pumping and discharge of fluids from within the drum D through cycling.

As the plunger 7 is pulled upwardly within the pump cylinder 1, by forcefully raising the handle 5, its valve 9, because of the force of fluids therein, will be seated upon and close off the passages 8. As the plunger 7 raises, the reduced pressure generated within the piston chamber 20, below the piston 7, will draw fluids from the drum through the inlet tube 17, opening the flapper or other valve 18, and further draw fluid into and fill up the piston chamber 20, as the plunger 7 is elevated fully, contiguously near the underside of the upper cap 12, as can be understood. When the plunger 7 attains that position, the expanding piston chamber 20 will be fully and completely filled with the drum fluids, as explained. As this time, pushing of the plunger handle 5 downwardly exerts pressure upon the fluid contained within the piston chamber 20, thereby forcing the flapper valve 18 to close. The plunger piston 7 is allowed to descend within the piston chamber fluids, because it bypasses the valve 9, opens to allow the plunger 7 to descend, under the pressure exerted upon its pump rod 6, and upon the pump handle 5. When the plunger 7 reaches the bottom of its stroke, in the manner as shown in FIG. 2, as it is pulled upwardly, its valve 9 closes, thereby forcing the fluids that previously bypassed the plunger 7 and its valve 9, and which filled to capacity the piston chamber 10, said fluids are then forced upwardly, by means of the plunger elevated within the pump cylinder 1, and be forced out the outlet 13, through the upper cap 12, and through the hose 11, for pumping to a another location.

As can be understood, the upward draw of the plunger 7, as it pumps fluid from the pump chamber 10, simultaneously draws additional fluid into the plunger chamber 20, through the flapper valve 18, to recharge that particular chamber 20. Thus, after the plunger 7 obtains the upper end of its stroke, as it then is forcefully shifted downwardly, in the manner as previously described, the newly charged pump chamber 20 presents its fluids for bypassing the valve 9, of the piston 7, in preparation for another pumping cycle. Thus, this particular pump can be repeatedly manually pumped, or perhaps even done mechanically by some form of motor and lever action, applied to the pump handle 5, to attain a continuous pumping of fluids from the drum, until such time as the drum becomes emptied. This occurs because the lower end of 21 of the inlet tube 17 is within proximity of the bottom of the drum, as can be further seem in FIG. 1.

The various other components, and the details of their construction, can be determined from reviewing the specific component drawings, as shown in the patent drawings, and as hereinafter described.

Figure 3:
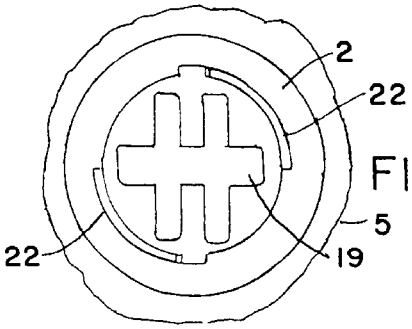
FIG. 3 provides a top view of the pump, and more specifically, its upper cap ring and plunger handle of FIG. 1.

For example, as can be seen in FIG. 3, the pump handle 5, which fits within the cap ring 2, in the preferred embodiment, is secured by means of its bayonet locking mechanism 22. There are grooves provided within the inner perimeter of the cap ring 2, which accommodates the insertion of the bayonet locking mechanism 22 therein. In addition, the upwardly projecting ribs 19, as previously explained, will extend upwardly sufficiently, or at least be formed within a handle 5, to allow for insertion of the fingers, to provide for manual manipulation of the handle, during usage of the pump.

Figure 4:
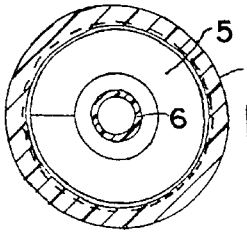
FIG. 4 is a transverse sectional view of the cap ring and the pump rod and cylinder and is taken along the line 4—4 of FIG. 2.
Figure 6:
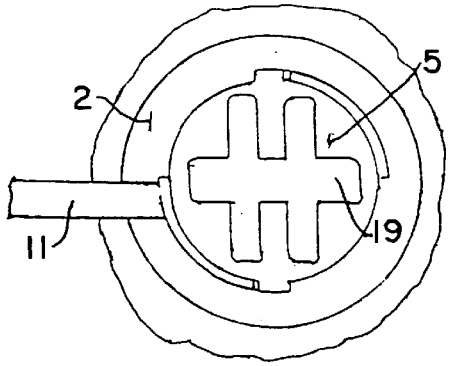
FIG. 6 is a top view of FIG. 5.

FIG. 4 provides a sectional view of the cap ring 2, through a portion of the handle 5, and shows the upper end of the pump rod 6 secured at the bottom of the said handle. FIG. 6 shows an upper view of the handle 5 with its upwardly projecting ribs 19, secured within the cap ring 2, and with the hose 11, extending therefrom.

Figure 7:
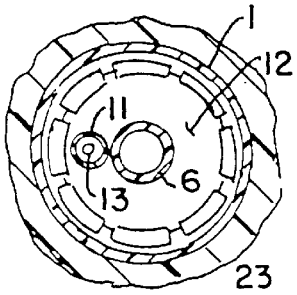
FIG. 7 is a transverse sectional view taken along the line 7—7 of FIG. 5.

FIG. 7 provides an upper view of the upper cap 12, with the outer perimeter biasing tabs 23, in its location below the upper cap, and which forces a fluid seal against the inner side walls of the pump cylinder 1. As previously explained, once this upper cap is shifted into its uppermost operative position, as shown in FIG. 5, it remains there, sealed against the interior of the pump cylinder 1. This FIG. 7 also discloses the extension of the pump rod 6 therethrough, in addition to the tube fitting 13 upon which the hose 11 secures.

The more specific construction of the upper cap 12 can be seen in FIGS. 16, 16*a*, 16*b*, and 16*c*. Aperture 24 shows the opening through which the pump rod 6 reciprocates.

Figure 8:
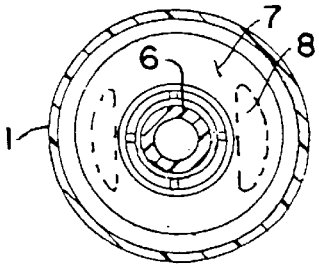
FIG. 8 is a transverse sectional view taken above the plunger or piston, and taken along the line 8—8 of FIG. 5.
Figure 9:
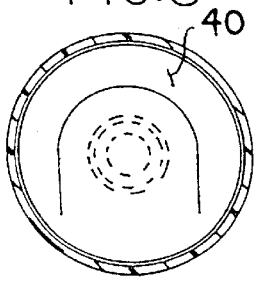
FIG. 9 is a transverse sectional view taken above the lower valve and lower cap, and taken along the line 9—9 of FIG. 5.
Figure 13:
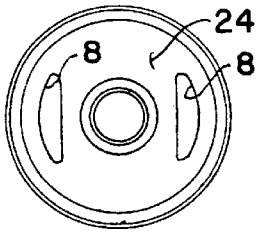
FIG. 13 is a top view of the plunger piston of this invention.
Figure 13A:
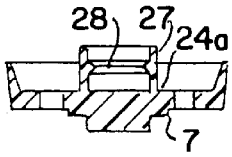
FIG. 13*a* is a cross sectional view of the plunger of FIG. 13.
Figure 13B:
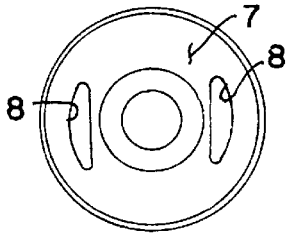
FIG. 13*b* is a bottom view of the plunger of FIG. 13.
Figure 14:
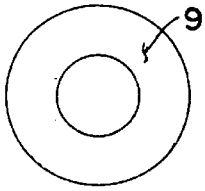
FIG. 14 is a plan view of the plunger piston valve.
Figure 14A:
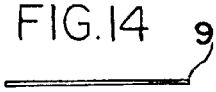
FIG. 14*a* is an edge view of the plunger valve.
Figure 15:
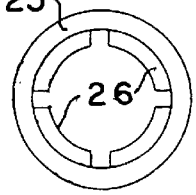
FIG. 15 is the retainer for holding the plunger valve in place.
Figure 15A:
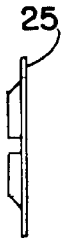
FIG. 15*a* is an edge view of the retainer of FIG. 15.
Figure 16:
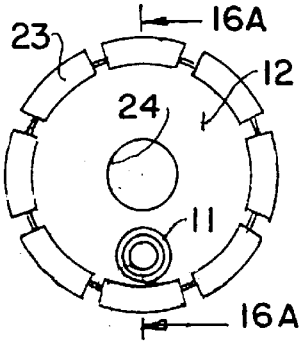
FIG. 16 is a top view of the plunger upper cap.
Figure 16A:
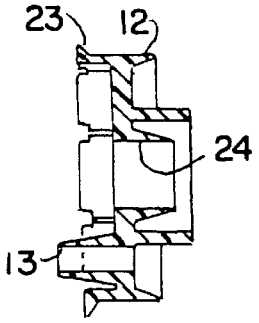
FIG. 16*a* is a sectional view of the upper cap of FIG. 16.
Figure 16B:
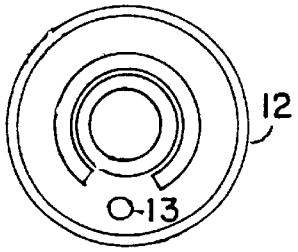
FIG. 16*b* is a bottom view of the upper cap of FIG. 16.
Figure 16C:
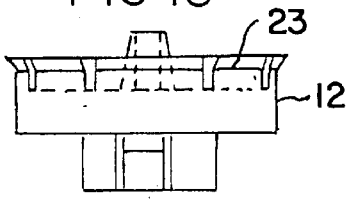
FIG. 16*c* is a side view of the plunger upper cap.

FIG. 8, as previously explained, shows the arrangement of the piston 7, its valve 8, and the connection of the lower end of the pump rod 6 therein, all arranged within the pump cylinder 1, as can be more clearly seen in FIG. 5. More specifically, the piston can be seen in FIGS. 13, 13*a* and 13*b*. As noted, it has a pair of apertures 8 therethrough. The valve 9, as can be seen in FIGS. 14 and 14*a*, rest upon the upper surface 24*a* of the plunger 7, and the valve 9 has the configuration of a washer, as noted in said FIGS. 14 and 14*a*. To hold the valve in place, a retaining ring 25, as can be seen in FIGS. 15 and 15*a*, having inwardly biasing tabs 26 secure downwardly onto and upon the upperly extending sleeve 27 of the valve, as can be seen in FIG. 13*a*. Its resilient tabs 26, bias against the outer surface of the integral sleeve 27, to secure the valve 9 in place, as can be understood. Internally of the sleeve 27 is a retention ring 28, integrally formed, and this ring is provided for reception and retention of the bottom end of the pump rod 6 therein, which has a lower groove, as at 29, into which the ring 28 snaps for engagement, as can be understood.

Thus, as previously explained, as the plunger moves downwardly, its valve 9 will fold upwardly, to allow fluids to bypass the piston, and alternatively as the plunger moves upwardly, within the pump cylinder 1, the valve will come to rest upon the apertures 8, and thereby preventing the bypassing of any fluids, during the upward stroke of the pump.

Figure 19A:
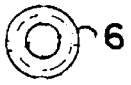
FIG. 19*a* is a bottom view thereof.
Figure 19:
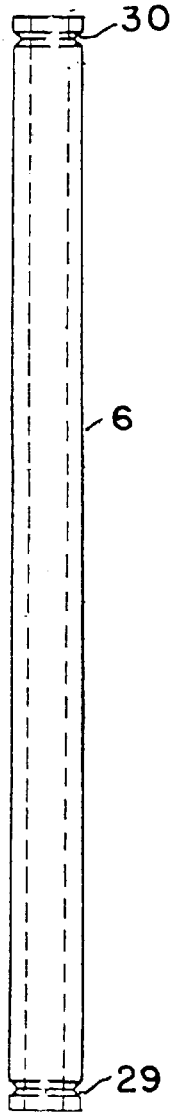
FIG. 19 is a side view of the pump rod.
Figure 20:
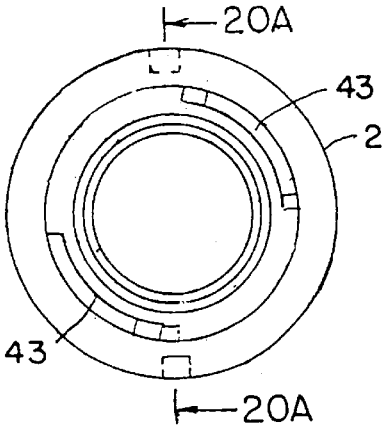
FIG. 20 is a top view of the pump cap ring.
Figure 20A:
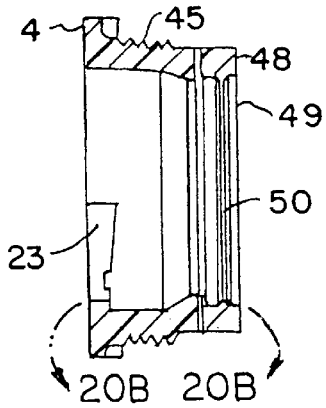
FIG. 20*a* is a transverse sectional view thereof, taken along with line 20*a*—20*a* of FIG. 20.
Figure 20B:
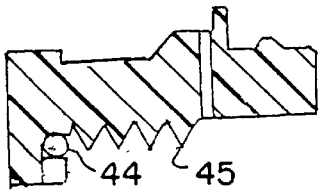
FIG. 20*b* is an enlarged view of a section of the cap ring taken along the line 20*b*—20*b* of FIG. 20*a;*
Figure 20C:
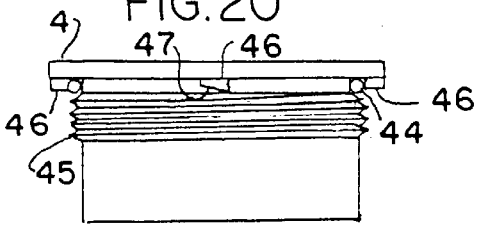
FIG. 20*c* is a side view of the cap ring.

The plunger rod, as previously reviewed, is shown in greater detail in FIGS. 19 and 19*a*. While the bottom of the plunger rod is retained to the piston 7, as previously explained, the upper end of the rod, which likewise retains a groove 30, is similarly connected into the bottom of the pump handle 5, in a manner to be subsequently defined.

Figure 10:
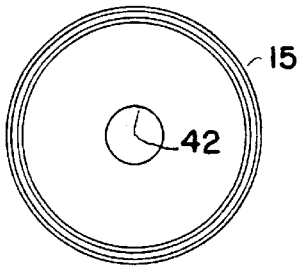
FIG. 10 is a transverse sectional view through the plunger cylinder looking downwardly towards the lower cap, and taken along the line 10—10 of FIG. 5.
Figure 10A:
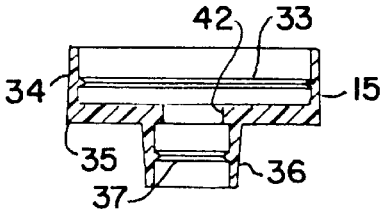
FIG. 10*a* is a sectional view taken through the lower cap.
Figure 10B:
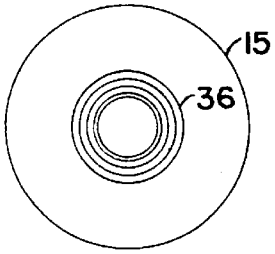
FIG. 10*b* is a bottom view of the lower cap.
Figure 12:
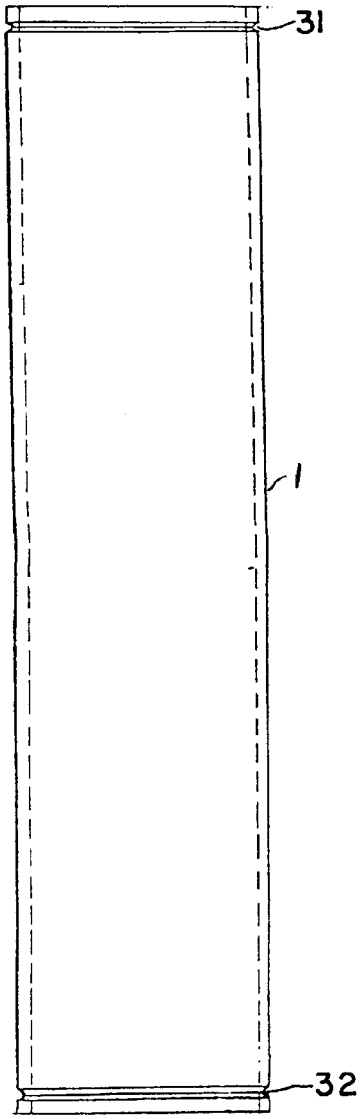
FIG. 12 is a side view of the plunger cylinder.
Figure 12A:
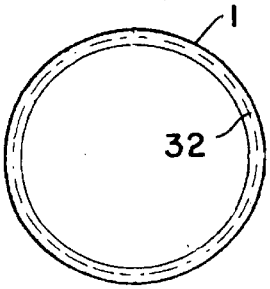
FIG. 12*a* is a bottom view of the plunger cylinder, as shown in FIG. 12.
Figure 18:
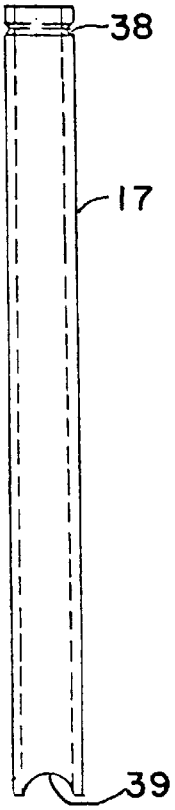
FIG. 18 is a side view of the pump inlet tube.
Figure 18A:
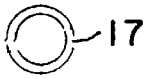
FIG. 18*a* is a bottom view thereof.

The pump cylinder 1 in more accurately shown in FIGS. 12 and 12*a*. The upper end of the cylinder likewise contains a retaining groove 31, which securely fastens within the cap ring 2, as to be subsequently defined. The bottom of the pump cylinder contains an additional formed groove 32, such that the bottom of the cylinder engages and secures within the lower cap 15, by connection to its internally arranged integral ring 33, as can be seen in FIG. 10*a*. These components, like the other component, as previously defined, are snap, fastened or engaged together. Threaded, fastening may connect these parts together. Thus, when the pump is assembled, its cylinder 1 is permanently engaged to the cap ring, and the lower cap, as can be seen. The lower cap is formed with an outer sleeve 34, a base portion 35, and a downwardly extending lower sleeve 36. The lower sleeve 36 has an integral ring 37 formed therein, and into the lower sleeve the upper end of the inlet tube 17 inserts. See FIG. 5. Also, as can be seen in FIGS. 18 and 18*a*, the upper end of the inlet tube also includes a groove 38 which snap fastens with the ring 37, of the defined lower cap. The bottom of the inlet tube has an arcuate groove 39, provided thereat, so as to prevent any sealing of the bottom of the tube, as with the internal bottom of the drum D, so that fluids will freely pass into the inlet tube 17, during functioning of the pump.

Figure 17:
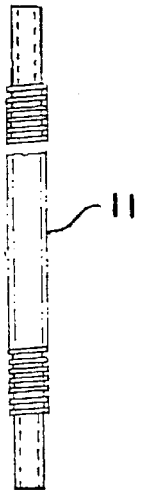
FIG. 17 is a side view, partially broken away, of the pump hose.

FIG. 17 shows the coil type of hose 11, which, as previously explained, connects with the upper cap 12, of the pump assembly. This is a coil type of hose, which can be extended and expanded during usage, but when the pump is initially manufactured and assembled, as previously explained, it may be coiled for temporary storage internally of the pump and around the pump rod 6, as previously described and shown in FIG. 2.

Figure 11:
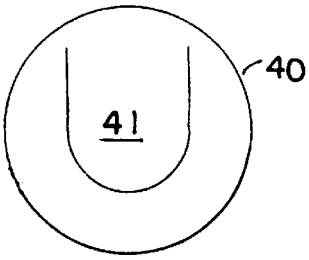
FIG. 11 is a plan view of the lower flapper valve of this invention.
Figure 11A:
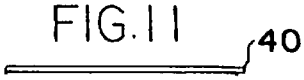
FIG. 11*a* is an edge view of the lower flapper valve.

The valve that locates within the lower cap 15, is more accurately shown in FIGS. 11 and 11*a*. As to be noted, this valve 40 is constructed as a flapper valve, having the flapper 41 integrally provided, but it may be constructed as other types of valves, such as a one-way ball valve, or other types of one-way valves as readily known in the art. Nevertheless, the flapper valve sits internally of the lower cap 15, generally overlying its inlet aperture 42. Hence, when the plunger is descending within the pump cylinder 1, the flapper valve will shift or fold upwardly, allowing the fluids within the piston chamber 20 to bypass such valve, and elevate into the piston chamber 20. On the other hand, as the plunger is elevated, the flapper valve 40 closes, thereby forcing any fluids within the pump chamber 10 to be forced upwardly and out through the coil hose 11, as can be understood. In addition, when the pump cylinder 1 is affixed within the lower cap 15, as through the engagement between its groove 32, and the locating of the cap ring 33 therein, this functions as a means for positioning and holding the valve 40 located, as to prevent its shifting or removal therefrom.

The more specific construction of the cap ring 2, can also be seen from FIGS. 20, 20*a*, 20*b* and 20*c*. As noted, it is sleeve like in construction. The upper interior of the cap ring includes retention means 43, which cooperate with the bayonet locking means 22 (see FIG. 3) of the pump handle to temporarily secure the pump handle in place, as when the pump is in storage, and not in use. As previously reviewed, a simple turning of the pump handle a quarter turn or some other degrees allows for its release. The cap ring includes its extending flange 4, and which may accommodate an O ring, as at 44, in order to provide a fluidic seal between the cap ring and the drum, when the cap ring is threadedly inserted therein. As to be noted, the cap ring includes a series of threads, as that 45, for providing a retention of the cap ring in place, within the drum. Obviously, other types of locking or fastening means may be used for the same purpose. In addition, the lower segment of the cap ring flange 4 may include some depending detent, as that 46, and these may lockingly engage with similar type upwardly extending detent provided adjacent the bung opening B of the drum, so that once the cap ring is firmly secured in place, and threadedly engage to the fullest, these detents will provide for a permanent engagement of these components together, to prevent the unauthorized removal of the pump, from the drum, once installed. This is an example of an alternative means for retention of the pump, and its cap ring, in place, once installed within the drum D. It can be seen that the downwardly extending detents 46 have a slight bevel to them, as at 47, to accommodate the securement of these components together.

The lower segment of the cap ring, as that 48, also includes an inner opening, as that 49, and within this opening is an integrally formed ring 50, as noted. The upper end of the pump cylinder 1, and more specifically, its integral groove 31, is provided! for snap fastening with the ring 50, to permanently secure the cylinder to the cap ring, when the pump is assembled.

The specific construction of the pump handle 5, can be noted in FIGS. 21, 21*a*, 21*b*, 21*c* and 21*d*. The raised ribs, or the depressed ribs 19, as the case may be, provided within the handle 5, can be seen in FIG. 21*c*. The pump handle has an outwardly extending portion, as that 48, which includes its bayonet locking mechanism 22, as previously reviewed. This is designed for providing engagement between the pump handle and the cap ring together, during storage, and when not in use. The bottom of the cap ring includes an outwardly extending sleeve like portion 49, which provides a cavity therein, as that 50, and the cavity includes an inwardly projecting integral rib or ring 51. It is within this sleeve that the upper end of the pump rod 6 engages, by securement of the ring 51 within its formed groove 30, as previously explained in FIG. 19. This permanently secures the pump rod to the handle, during assembly. Obviously, it is just as likely that the sleeve 49 may simply be a downwardly extending stud, with a ring or groove formed upon its outer lower surface, such that the pump rod 6 could slide thereon, and be engaged by means of an internal arranged groove, to provide for this permanent fastening of these components together. This is just an alternative.

Figure 21A:
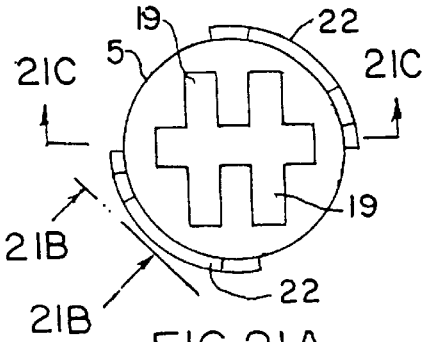
FIG. 21*a* is a top plan view thereof.
Figure 21B:
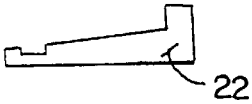
FIG. 21*b* is a partial view of the bayonet locking mechanism of the pump rod handle, taken along the line 21*b*—21*b* of FIG. 21*a*.
Figure 21:
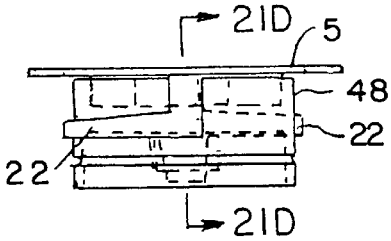
FIG. 21 is a side view of the pump rod handle.
Figure 21C:
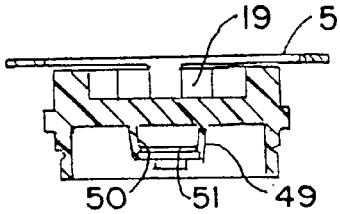
FIG. 21*c* is a transverse sectional view of the pump rod handle, taken along the line 21*c*—21*c* of FIG. 21*a*.
Figure 21D:
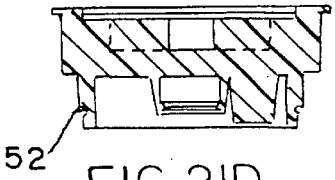
FIG. 21*d* is a vertical sectional view of the pump rod handle, taken along the line 21*d*—21*d* of FIG. 21.

As can also be seen in FIG. 21*d*, the lower segment of the pump handle, upon its outer perimeter, includes a groove, as that 52, to accommodate an O ring, so that when the pump, handle is engaged and locked within the cap ring, it provides for a fluidic seal thereat to prevent leakeage, particularly when the drum may be located upon its side, and rolled for repositioning by the worker.

The description of the preferred embodiment as provided therein, defines an integral interconnection of various rods, tubes, caps, seals, gaskets and the like to form this pump. Their means for interconnection, as detailed herein, could be done by other means, as readily understood by those skilled in the art. Hence, variations or modifications to the subject matter of this invention, as shown and described in this disclosure, are intended to be encompassed within the scope of the principle of the invention as defined herein. Such variations as to the methods of interconnection of the components together, as may be understood by those skilled in the art, are intended to be considered as part of the invention as defined herein. The description of the preferred embodiment, as shown in the drawings, is set forth for illustrated purposes only.

What is claimed is:

1. A polymer molded fully integrated pump for use in holding and dispensing fluid from a drum, comprising a container, and the pump means for delivering fluid from said container, said pump including a cylinder, said cylinder having upper and lower ends, the lower end of the cylinder incorporating a closure cap having a fluidic seal thereat, the closure cap having an inlet therethrough, a low profile flapper valve normally closing the inlet, but capable of opening during pump operation, the upper end of the cylinder having a cap ring applied thereto and forming a fluidic seal thereat, said cap ring capable of securing within the bung opening of the drum, a pump rod and plunger piston located within the cylinder, and capable of shifting vertically therein during the stroking of the pump, said plunger piston having at least one passage provided therethrough, a low profile flapper valve provided upon the plunger piston which in cooperation with the vertical shifting of the pump rod during actuation provides for recharging and dispensing of any fluid contained within the drum, whereby usage of said first and second flapper valves within the cylinder provides for a maximum stroke of operation for the piston rod and plunger piston within the cylinder during operations of the said drum pump.

2. The drum pump of claim 1 wherein said cap ring threadedly engages within the bung opening through the said drum.

3. The drum pump of claim 1 including a bayonet lock provided upon the cap ring, and said cap ring connecting by bayonet lock to the opening of the drum pump during its securement.

4. The drum pump of claim 2 and including means for permanently locking the cap ring to the bung opening of the drum pump.

5. The drum pump of claim 2, including a handle securing to the upper end of the pump rod, said handle capable of removably connecting within the cap ring, while the pump is not in use, but further capable of release therefrom, when the pump is stroked for the dispensing of fluid from the drum.

6. The drum pump of claim 5 wherein the pump handle includes a gripping means provided upon its upper surface to provide for its release, upon turning, from the cap ring.

7. The drum pump of claim 2, and including an upper cap, said upper cap slidingly engaging upon the pump rod, said upper cap initially securing upon the pump rod and disposed proximate the downward end of said pump rod, and when the handle and pump rod are initially pulled upwardly, to initiate the stroke of the drum pump, said upper cap shifts upwardly within the pump cylinder, and then permanently secures thereat, to provide a fluidic seal at the upper end of the pump cylinder during its usage.

8. The drum pump of claim 7 and including a passage provided through the upper cap, a hose securing to the upper cap and communicating with its opening, said hose normally coiled around the pump rod, and upon the upward shifting of the upper cap, upon pulling of the handle and pump rod, the coiled hose extending through the cap ring, in preparation for its uncoiling and conveyance of fluid during dispensing from the drum.

9. The drum pump of claim 2 wherein the cylinder forms a fluidic seal with the cap ring.

10. The drum pump of claim 9 wherein said fluidic seal is formed through an O ring.

11. The drum pump of claim 2 wherein said cylinder forms a fluidic seal with the lower cap.

12. The drum pump of claim 1 wherein an O ring provided between the cylinder and the lower cap to provide for a fluidic seal thereat.

* * * * *